US005883470A

United States Patent [19]

Hatakeyama et al.

[11] Patent Number: 5,883,470

[45] Date of Patent: Mar. 16, 1999

[54] FAST ATOMIC BEAM SOURCE WITH AN INDUCTIVELY COUPLED PLASMA GENERATOR

[75] Inventors: Masahiro Hatakeyama; Katsunori Ichiki, both of Fujisawa; Yasushi Toma, Kawasaki; Masao Saitoh, Fujisawa, all of Japan

[73] Assignee: Ebara Corporation, Tokyo, Japan

[21] Appl. No.: 800,278

[22] Filed: Feb. 13, 1997

[30] Foreign Application Priority Data

Feb. 16, 1996 [JP] Japan ..... 8-054057

[51] Int. Cl.[6] ..... H05H 3/02

[52] U.S. Cl. ..... 315/111.51; 315/111.81; 250/251

[58] Field of Search ..... 315/111.31, 111.51, 315/111.81; 250/251

[56] References Cited

U.S. PATENT DOCUMENTS

| | | | |
|---|---|---|---|
| 5,108,535 | 4/1992 | Ono et al. | 250/251 X |
| 5,468,955 | 11/1995 | Chen et al. | 315/111.81 X |
| 5,616,180 | 4/1997 | Lee et al. | 250/251 X |

FOREIGN PATENT DOCUMENTS

| | | |
|---|---|---|
| 0 531 949 | 3/1993 | European Pat. Off. . |
| 0 639 939 | 2/1995 | European Pat. Off. . |

OTHER PUBLICATIONS

Fusao Shimokawa et al., "Reactive–fast–atom beam etching of GaAs using $Cl_2$ gas", J.Appln.Phys., vol. 66, No. 6, pp. 2613–2618, American Institute of Physics, 1989.

Patent Abstracts of Japan, vol. 095, No. 001, 28 Feb. 1995 & JP 06 289198 A (Ebara Corporation), 18 Oct. 1994 * abstract *.

Journal of Vacuum Science and Technology: Part A, vol. 13, No. 5, 1 Sep. 1995, pp. 2508–2512, XP000550444, Imai, F. et al.: "Performance Characteristics of an Oxygen Radical Beam Radio–Frequency Source" * p. 2508, right–hand column, paragraph 1; figure 1 *.

IBM Technical Disclosure Bulletin, vol. 36, No. 10, 1 Oct. 1993, pp. 501/502 XP000412462 "Compact High–Density Radical Generator" * the whole document *.

*Primary Examiner*—Robert Pascal
*Assistant Examiner*—Justin P. Bettendorf
*Attorney, Agent, or Firm*—Wenderoth, Lind & Ponack, L.L.P.

[57] ABSTRACT

A fast atomic beam (FAB) source is capable of generating fast atomic beams having characteristics of a high beam density, precise directionality, and a wide range of controlled out put energy levels. The FAB source includes a discharge tube, an inductively coupled plasma generator for generating gas plasma in the discharge tube from gas introduced therein, positive and negative electrodes for accelerating ions to control the beam for a variety of energy levels. The negative electrode has a beam control opening for generating a FAB, wherein directionability, neutralization factor, and other FAB characteristics are controlled.

20 Claims, 4 Drawing Sheets

FAST ATOMIC BEAM SOURCE WITH AN INDUCTIVELY COUPLED PLASMA GENERATOR

BACKGROUND OF THE INVENTION

1. Field of the Invention

The present invention relates to a beam source for fast atomic beams which are generated from plasma, wherein output energy can be controlled over a wide range of energy levels.

2. Description of the Related Art

Conventional fast atomic beam sources will be reviewed first. Atoms and molecules undergoing thermal motion in ordinary atmosphere have kinetic energy of generally about 0.05 eV. Compared to such relatively low kinetic energies, atoms and molecules moving with a much higher level of kinetic energy are referred to as fast atoms. When such fast atoms are radiated as a narrow directed beam, they are referred to as a fast atomic beam (shortened to FAB hereinbelow).

Of the various known sources for generating FAB based on gaseous atoms, FIG. 1 shows a schematic representation of an example of an argon-based FAB having a kinetic energy in a range of 0.5 to 10 KeV. The main components are a cylindrical negative electrode 1, a donut shaped positive electrode 2, a high voltage source 3, a gas inlet tube 4, an argon gas plasma 6, FAB emission holes 7 and FAB 8.

All components excepting the electrical power source for the beam source and a discharge stabilizing resistor (not shown) are housed in a vacuum container, and after the container has been sufficiently evacuated, argon gas is introduced into the cylindrical negative electrode 1 through the gas inlet tube 4. A direct current (dc) voltage is applied from high voltage dc source 3 so that the positive electrode 2 will be at a positive potential and the negative electrode 1 will be at a negative potential. The result is that an electrical discharge occurring between the positive and negative electrodes generates a plasma 6, thereby providing argon ions and electrons.

The electrons emitted from the bottom surface 1*a* of the cylindrical negative electrode 1 are directed to the positive electrode 2 and accelerated by positive potential, and after passing through the center hole in the positive electrode 2 reach the bottom surface at the opposite end of the cylindrical negative electrode 1, where the electrons lose speed and reverse their flight direction because of negative potential. The electrons, which are now moving in the opposite direction, begin to be accelerated towards the positive electrode 2. Thus, the electrons undergo high frequency oscillations in the plasma space between the bottom surfaces of the negative electrode 1 through the center hole in the positive electrode 2. The oscillating electrons collide with the argon atoms and generate many more argon ions. The argon ions thus generated are accelerated towards the bottom surface 1*a* of the cylindrical negative electrode 1 thereby attaining a kinetic energy. The level of kinetic energy is about 1 KeV, for example, when the potential difference between the positive and negative electrodes is 1 KV. The space near the bottom surface 1*a* of the negative electrode 1 is a U-shaped region for the high frequency oscillating electrons, and contains a large percentage of low-energy electrons. The argon ions which are injected into this space return to argon atoms by colliding/recombining with the electrons. Because the mass of electrons is negligibly small in comparison to argon ions, the kinetic energy of argon ions is almost not affected by the collision process with the electrons, and the kinetic energy of argon ions is transferred substantially to the argon atoms to produce a fast atomic beam. Therefore, the kinetic energy of the fast moving argon atoms is about 1 KeV. Fast moving argon atoms are emitted as an argon FAB from the discharge holes 7 which are provided in a bottom surface of the negative cylindrical electrode.

However, conventional FAB sources are suitable for applications which require a potential difference of higher than 1 KeV to generate atomic particles having sufficiently high discharge current to carry out processes thereof. At low voltages, it is only possible to generate a low discharge current beam, and therefore, it is necessary to adopt other means to obtain high beam density. The situation is the same when magnets are used to generate magnetic fields, and is characteristic of a dc discharge process. Therefore, low discharge current means that the volume of ions generated is low, and consequently, the strength of the output FAB beam is also low. Furthermore, the conventional FAB sources can only produce beams having poor directionality because of their high beam dispersion characteristics, which is unsuitable for satisfying critical requirements of modern microfabrication, wherein a FAB must be able to fabricate three-dimensional fine objects of high aspect ratios in any orientation.

Therefore, there has been a need for a source of generating fast atomic beams which is capable of producing high beam density, precision directionality and a wide range of output energy levels.

SUMMARY OF THE INVENTION

It is an object of the present invention to provide a fast atomic beam source which is capable of producing fast atomic beams having a high beam density, precision directionality and a wide range of controlled output energy levels.

Such object is achieved in accordance with the invention by a fast atomic beam source comprising: a plasma control means including a discharge tube; an inductively coupled plasma generator; a gas inlet; and a beam control means including a positive electrode having particle control openings disposed in an upstream section of the discharge tube; a negative electrode, having a beam control opening, disposed downstream of the discharge tube; and a direct current voltage generation device for applying a biasing voltage between the positive electrode and the negative electrode.

According to the basic configuration of the fast atomic source presented above, the energy level of the beam emitted from the beam control opening in the downstream electrode is controlled by the dc voltage applied to the two electrodes. Inductively generated high density plasma produces a high density of charged particles in the space between the two electrodes so that the positive ions are accelerated towards the negative downstream electrode and are neutralized within the beam control opening of the negative electrode to emit a high density fast atomic beam from plasma region.

An aspect of the basic configuration of the beam source is that a plurality of beam control openings may be provided in the downstream electrode so that a plurality of beams having high beam density can be produced from one beam source.

Another configuration of the present FAB source is that both of the electrodes may be disposed downstream of the plasma forming section of the discharge tube. The ionic particles which have passed through the upstream electrode are accelerated towards the negative electrode as before, and charge neutralization process takes place within the beam control opening as before-mentioned to emit a fast atomic beam or plurality of beams.

In accordance with the basic configuration of the FAB source presented above, a high density beam having any desired energy level can be produced, and the beam can be directed precisely to a desired direction for targeting a fine fabrication object. Gas particles introduced into the discharge tube of the FAB source from the gas inlet tube are excited by the inductively coupled plasma generator through the application of high frequency ac current on the excitation coil of the discharge tube, thereby producing a plasma of the input gas. Two plate electrodes are disposed so that one electrode is positioned upstream of the plasma forming section and one electrode is positioned downstream of the plasma forming section in the discharge tube. The downstream electrode is provided with a beam control opening or a plurality of openings.

In another configuration of the FAB beam source, when both of the electrodes are disposed in a downstream region of the plasma forming section, a FAB which has any level of kinetic energy is generated corresponding to applied voltage therebetween in a compact space in the downstream region of the discharge tube. Unlike the conventional source, the present FAB source is configured so that the plasma generation process operates independently of the ion acceleration process of the source, thus permitting generation of high density plasma even when an output beam energy of low level is required. Therefore, irrespective of whether the electrodes are located upstream and downstream with respect to the plasma forming section or both in the downstream section of the discharge tube, the discharge voltage applied to the electrodes can be adjusted to a high or low value to match the requirements of the output beam energy.

The function of the beam control opening can be classified into three large categories concerning the requirements of directionality and neutralization factor in the output FAB beam.

When a mixture of high density atomic beams and ion beams are required, the depth or length of the beam control opening should be in the range of 1~5 times the opening diameter. In this case, the neutralization factor is relatively low, and less than about 40% of the ions are neutralized in the beam control openings. The directional property of a beam depends also on the aspect ratio of the beam control opening, and because the beam tends to disperse after leaving the opening, the directionality is relatively poor in this case.

When a highly directional beam is required, the depth or length of the beam control opening should be in the range of 5–20 times the opening diameter. The neutralization factor is in the range of 40~70%.

When an ultra high, directionality and high beam density is required, the depth or length of the beam control opening should be greater than 20 times the opening diameter. The neutralization factor is also increased to beyond 70%. Most of the radicals are deactivated within the space of the opening, and therefore, highly refined fast atomic beams can be produced in this range of aspect ratios of the beam control opening.

DESCRIPTION OF THE PREFERRED EMBODIMENTS

Preferred embodiments of the FAB source of the present invention will be explained with reference to FIGS. 2 to 4B. Throughout the description of the beam source and processes, the terms "upstream" and "downstream" are in reference to the plasma forming section of the discharge tube and the direction of output FAB.

Figure 1:
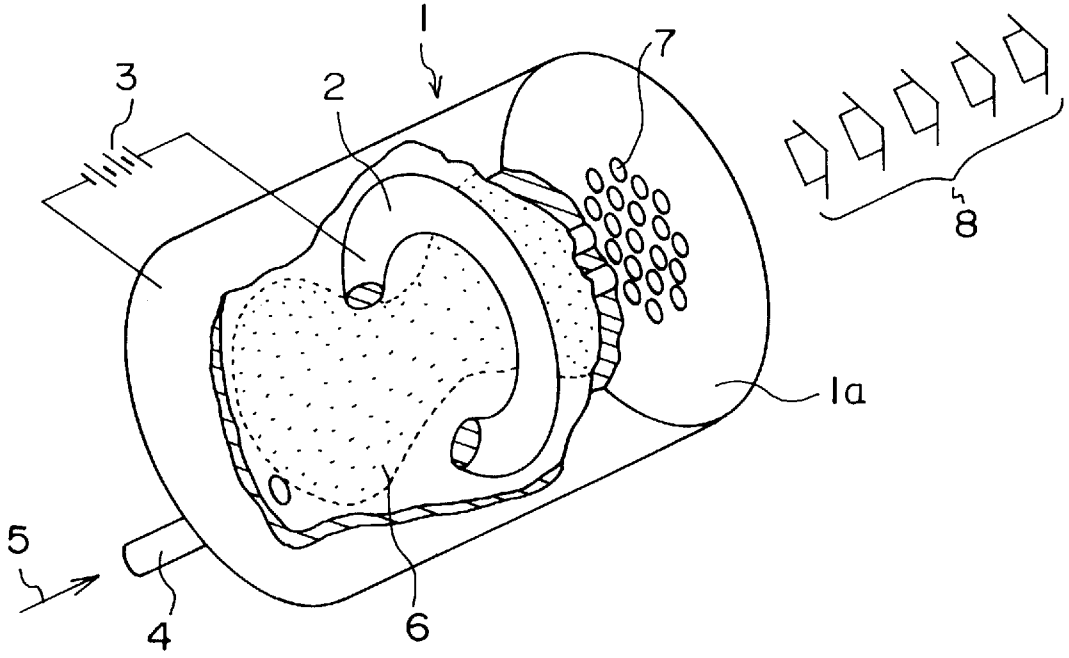
FIG. 1 PRIOR ART
FIG. 1 is a schematic drawing of a conventional FAB source.
Figure 2:
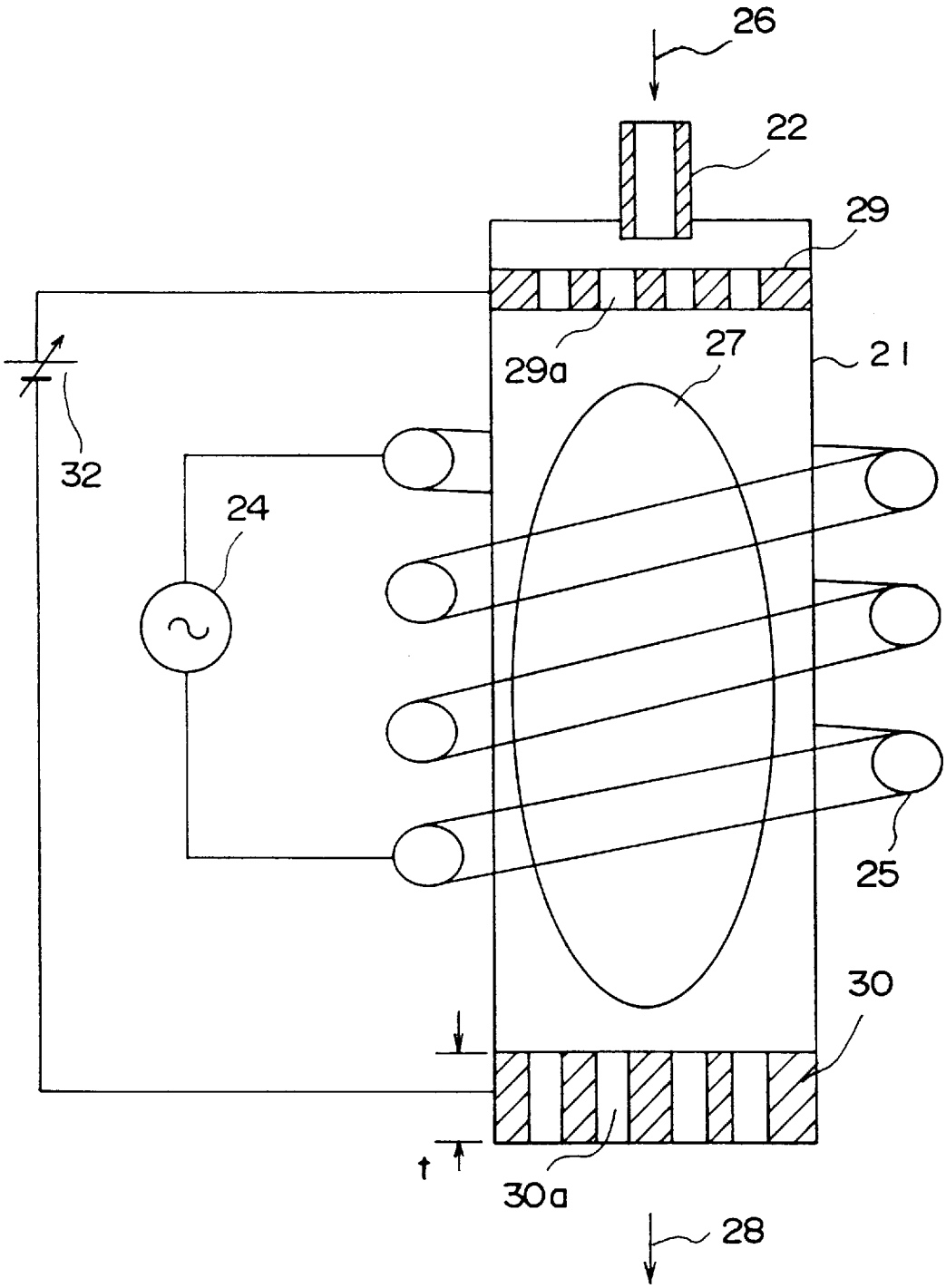
FIG. 2 is a schematic representation of a first embodiment of the FAB source of the present invention.

FIG. 2 is a schematic representation of the FAB source comprising a discharge tube 21 made of a ceramic material or quartz, a gas inlet tube 22 and two plate-type electrodes 29, 30. The upstream electrode 29 is provided with gas passages 29*a*, and the downstream electrode 30 (with respect to the direction of emission of FAB) is provided with beam control openings 30*a*. The internal diameter of the discharge tube may range 15~300 mm. Also, in the central region of the tube, an excitation coil 25 of one to three turns is provided for generating a high density plasma by applying an excitation magnetic field from an inductively coupled plasma generator 24 at 13.56 MHz. In this embodiment, the plate type electrodes 29, 30 are respectively disposed in upstream and downstream regions of a plasma region 27, and by applying a dc biasing voltage to two electrodes 29, 30, the positive ions of the gas particles are accelerated towards the negative electrode 30, thereby outputting a fast atomic beam having an energy, corresponding to the biasing voltage, through the beam control openings 30*a* provided on the negative electrode 30. In conventional FAB sources driven by a dc discharge, unless a voltage of over 1 KV is applied, high beam current cannot be obtained even with the use of magnetic fields generated by magnets. However, in the present device, high current plasma discharge can be generated at any voltage, from low to high values of the biasing voltage on the two electrodes 29, 30. The energy level of the FAB thus generated is dependent on the magnitude of the applied biasing voltage.

For example, using an inductively coupled plasma generator, a plasma density ranging from $10^{11}$–$10^{12}$ ions/$cm^3$ can be generated easily. The precision directionality of the generated FAB is achieved by providing the beam control openings 30*a*, for example, with a diameter of 1 mm and a length of 10 mm as determined by the thickness t of the negative electrode 30. By changing the thickness t of the negative electrode 30, for example, by making it thicker than 20 mm, a neutralization factor of higher than 70% can be obtained, and output beams having a high percentage of neutral atoms and highly directional character can thus be produced. Micro-fabrication work as disclosed in such documents as Japanese Patent Application No. H7-86538, Patent Application No. H7-86543 and Patent Application H6-156811, require a high directionality beam, and it is necessary to utilize the type of FAB described above. Also, the present device is able to produce a high beam density and a lower energy beam than those produced by conventional FAB sources, and such beams are useful in efficient fabrication of semiconductor materials without producing internal damage to the semiconductor devices.

The capability of producing a three dimensional microfabrication is required also in micro- or ultra-micro machining fields as well as in multi-faceted machining of microobjects, and it is important to be able to control the energy level of high density FAB.

Figure 3:
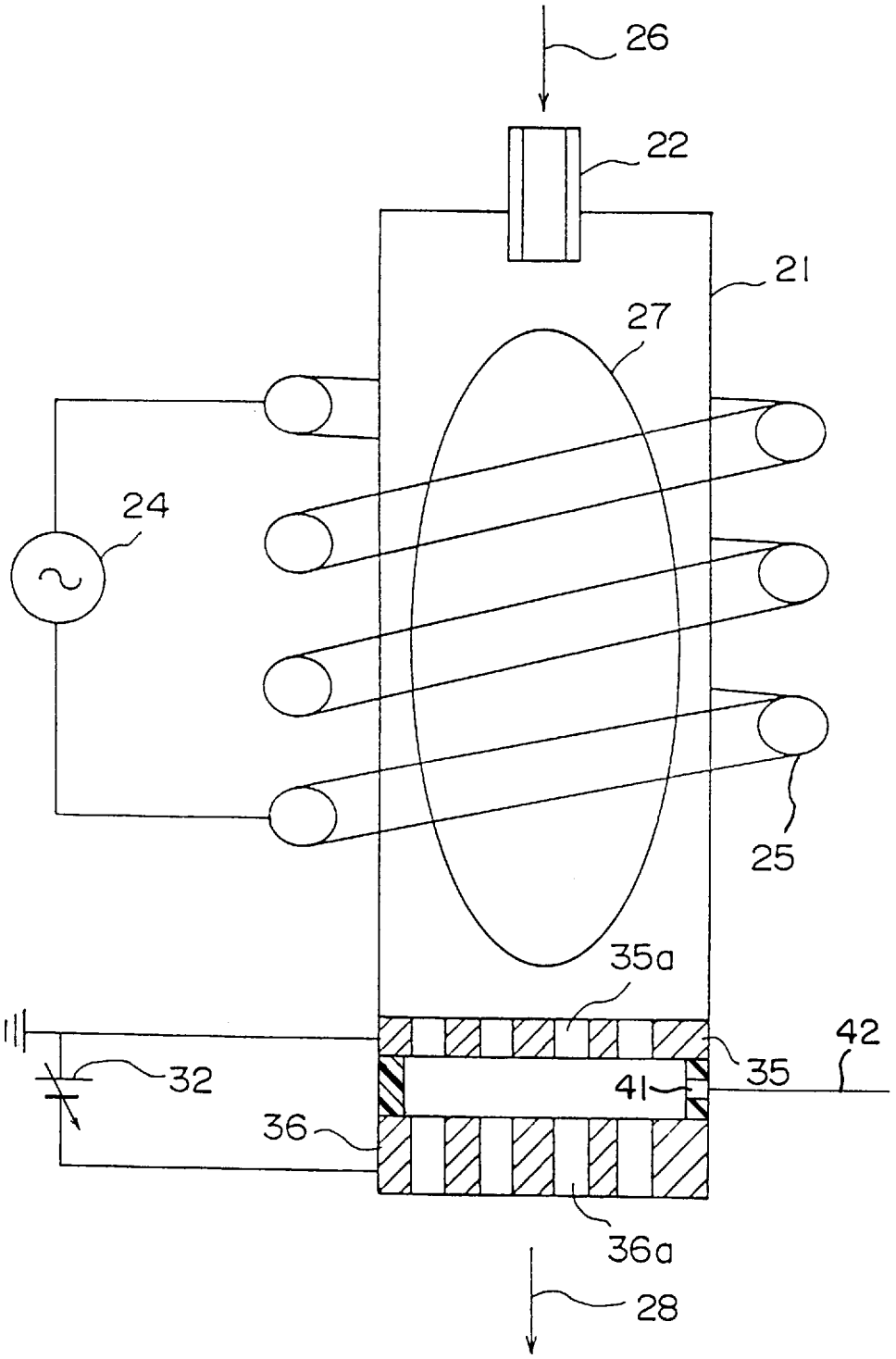
FIG. 3 is a schematic representation of a second embodiment of the FAB source of the present invention.

FIG. 3 shows a second embodiment of the FAB source of the present invention. In this configuration, both electrode plates are disposed in the downstream section of the plasma forming section 27. The method of producing the plasma is the same as in the first embodiment, and the use of the discharge tube 21, induction coupled high frequency generator 24 and the excitation coil 25 are also the same. Two plate electrodes 35, 36 are disposed parallel to each other. The upstream electrode 35 is provided with particle control openings 35*a* having predetermined electrode thickness and opening size. The downstream electrode 36 is provided with beam control openings 36*a* having pre-determined size and length (thickness of the electrode 36). The separation distance between the two plate electrodes 35, 36 should also be controlled. The characteristic properties of FAB generated under different beam producing parameters, such as sizes and length of the openings, are quite different from each other. For example, when the thickness of the plasma sheath (space charge region) is 1 mm, the diameter of the upstream openings 35*a* is 1 mm and the length thereof is 0.5 mm. Under these operating conditions, plasma leakage occurs into the space between the two plate electrodes 35, 36, leading to a phenomenon of diffusion of the plasma. The positive ions are accelerated towards the downstream negative electrode 36, and the ions are neutralized within the beam control openings 36*a* and are emitted as FAB. The openings in the upstream electrode 35 and in the downstream electrode 36 have the same diameter and are aligned with respect to each other. Depending on the amount of ions introduced into the electrode space between the plate electrodes 35, 36, arc discharge may sometimes occur therebetween under unfavorable operating conditions. For this reason, the separation distance between both electrodes is adjusted to about 5–100 mm. For example, for hydrogen chloride gas, a separation distance of about 15 mm is considered to be optimum.

There are a plurality of particle control openings 36*a* provided in the downstream electrode 36, and the relationship between the diameter and the length (thickness) of such openings is the same as in the first embodiment. To produce a low-energy FAB, the biasing voltage is set to 200~300 eV, and the length of the opening 36*a* may be varied from 2, 10 to 50 mm. When the length is 2 mm, for example, the density of FAB generated as well as radical atoms emitted from the source are high, but the directionality and neutralization factor is inferior to the cases of 10 and 50 mm length. When the length is 10 mm, the directionality and neutralization factor are both superior to the case of 2 mm length, however, the discharged radicals are less active and the quantity of radicals produced is also less. When the length is 50 mm, directionality and neutralization factors are both high, and the quantities of residual gas particles and radicals are significantly reduced. Such FAB characteristics are desirable for fabrication or radiation thereof in ultra-high vacuum.

Operating parameter control is important to generate a FAB optimum for special conditions, which is required to fabricate in various conditions, such as different degrees of vacuum and active radicals required for operation. For example, for fabrication of semiconductor materials such as GsAs, Si and $SiO_2$ using FAB, the length of opening 36*a* of the electrode 36 is 2 mm optimum to produce highspeed fabrication, wherein pattern size is larger than 5 $\mu$m. For multi-faceted micro-fabrication work on fine objects, or for pattern sizes less than 5 $\mu$m, 10–50 mm opening length is optimum for fabricating fine-structures having a high aspect ratio. For ultrafine micro-fabrication of advanced devices such as quantum effect devices or for processing in ultrahigh vacuum atmosphere, the length of beam control opening 36*a* should be 50 mm.

Figure 4A:
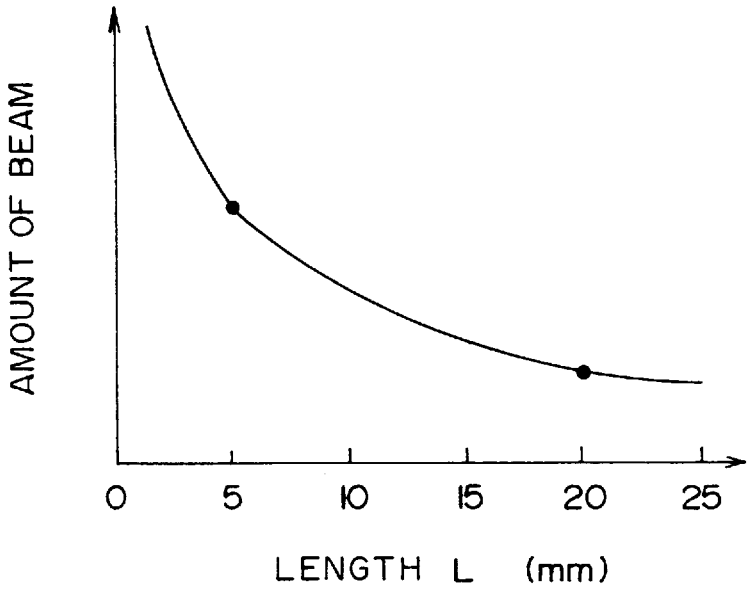
FIG. 4A is a graph showing a relationship between the length of a discharge opening and the quantity of the beam produced.
Figure 4B:
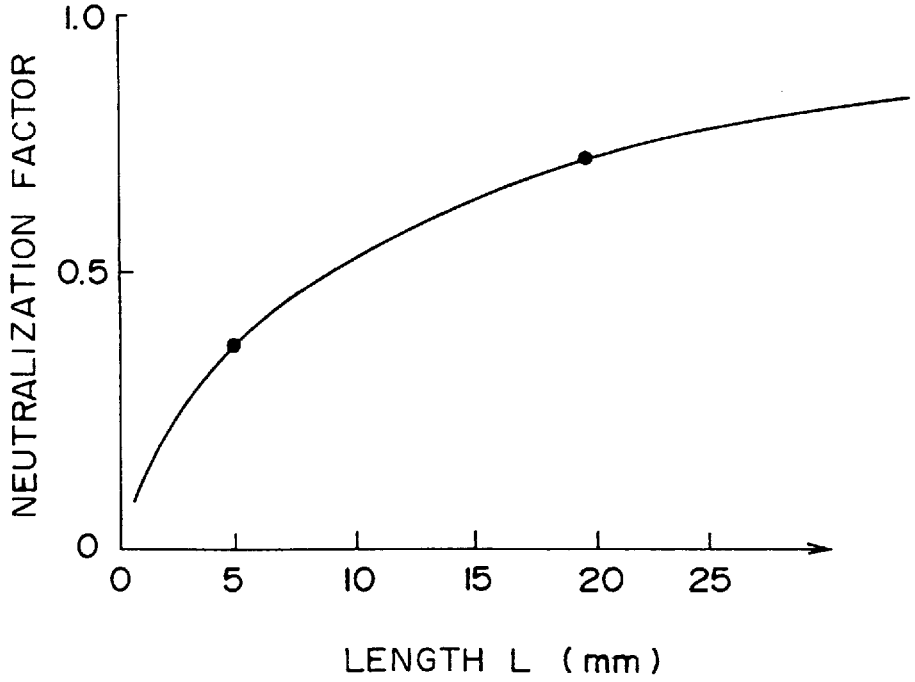
FIG. 4B is a graph showing a relationship between the length of the discharge opening and a neutralization rate.

FIG. 4A is a graph showing a relationship between the length (depth) L of the beam control opening and the density of the beam generated, and FIG. 4B is a graph showing a relationship between the length (depth) L of the beam control opening and the neutralization factor. As can be seen in these graphs, the aspect ratio of the beam control opening determines the characteristic properties of the output beam such as the directionality and neutralization factor as well as the degree of dispersion of the beam in the fabrication vessel. Therefore, it is necessary to customize the aspect ratio of the openings to match the requirements, of each application of the FAB source.

When the two electrodes are placed in the downstream section of the discharge tube, the relationships are similar. However, the aspect ratios of the particle control openings and the beam control openings greatly affect the final characteristic properties of the output beam. More specifically, the volume of the ions introduced into the electrode space between the upstream and downstream electrodes is affected by the aspect ratio of the particle control openings in the upstream electrode. To optimize this effect, when the diameter of the particle control openings is less than a value of the plasma sheath dimension, the length of the particle control opening should be 0.2~1 times such value. For example, when the opening diameter is 1 mm and the length is 0.2~1 times the opening diameter, it is insufficient for plasma shielding, and a large volume of ions is introduced into the electrode space. The result is a production of high density ions by leaking into the space between the two electrodes and accelerating towards the negative electrode.

By making the upstream opening diameter to be 1–3 times of the value of the plasma sheath length, ions in the plasma which leak into the space between the electrodes should be selectively accelerated. The plasma which is leaking through the openings in the upstream electrode is dispersed and its density drops, thereby permitting the electrons and ions to move independently. In other words, a plasma state has now been largely extinguished in the space between two electrodes, and the ions are able to be accelerated towards the negative electrode by the effect of the biasing dc voltage. Therefore, the degree of leaking plasma should be controlled by selecting the diameter of the upstream opening to be 1~3 times the plasma sheath length so that the plasma leakage rate is compatible with the ion dispersion rate occurring in the space between two electrodes. When the upper limit of 3 times of the plasma sheath length is exceeded, the above-mentioned effect becomes less sufficient, resulting in an increase in off-axis components of the accelerating ions.

When the two electrodes become misaligned, namely the corresponding openings of both electrodes where the ions or FAB pass through are misaligned, then the proportion of accelerated ions hitting the upstream surface of the downstream electrode increases, and the efficiency of FAB generation becomes decreased. To resolve such problems, a hollow insulation member or spacer 40 may be placed between the two electrodes so that an integrated electrode unit may be obtained and machined as a whole so that alignment of the openings can be achieved with high precision.

When the diameter of the particle control opening is less than 1 times the plasma sheath length, there is only a minor amount of plasma leakage into the space between the two electrodes, and then ions of extremely low energy levels are introduced in the electrode space and are emitted from the beam control opening of the downstream electrode in accordance with the energy levels imposed by the dc bias voltage.

The pressure in the space between the two electrodes can be reduced in comparison to the pressure in the plasma forming section by providing an exhaust hole 41 in the side wall of the discharge tube, e.g. in spacer 40, or by performing differential evacuation of the space between the two electrodes via evacuator 42 shown schematically in FIG. 3. For example, if the pressure difference is ¼, the effective particle density of the residual gas particles in the space between the two electrodes can be reduced significantly. By adopting this arrangement, the plasma density is reduced and the rate of collision of the ions with the residual gas particles is significantly reduced. Thus, the freedom of movement of the ions is increased, and the effect of the impressed bias voltage can be accurately reflected in the final property characteristics of the output beam.

The volume of the ions introduced into the electrode space and the pressure therein can be controlled more precisely by controlling the electrode separation distance, e.g. by the size of spacer 40. This control prevents excessive leakage of the plasma into the electrode space and the resulting possibility of arcing between the electrodes. In this case, the high density plasma generated in the inductively coupled plasma generation section can be introduced directly into the electrode space through the opening in the upstream electrode, and a glow discharge process may be allowed to take place between the electrodes at a low biasing voltage. In this case, high density plasma is obtained even under low voltage dc biasing, thereby making it possible to generate high density FAB.

It is also possible to apply pulsed biasing voltage to the two electrodes. Such a procedure makes it possible to generate high density FAB by accelerating high density ions in the electrode space, even if arcing is apt to occur between the two electrodes in the event of high density ions therebetween.

The features of the present FAB source are summarized as follows. The present device is able to overcome the conventional difficulties associated with dc discharge type FAB sources that input low excitation energy into the discharge tube does not generate sufficiently high density of plasma, and consequently is unable to produce a fast atomic beam (FAB) having a low energy level. Furthermore, the quality of the FAB produced by the conventional device was such that directionality of the beam was poor, and the beam dispersion in the fabrication vessel was large, and it was difficult to radiate the beam precisely to a targeted region of a fabrication object. The present device has demonstrated that high density FAB can be realized with beam energy over a wide range of controlled energy from low to high levels.

By altering the configuration of the plate electrodes and the shape of the openings provided in the both the first and second electrodes as well as their separation distance, it is possible to control the degree of directionality and the amount of radicals and residual gas particles discharged into the fabrication space. Such FABs having specific characteristics are important in advanced technologies required in high performance device fabrications, for example, micro-optical devices such as quantum effects devices and low-energy fabrication of three-dimensional objects so as to minimize internal structural damage as well as micro-fabrication of multi-faceted optical devices. Significant opportunities are believed to exist for the present FAB source to provide new avenues of discoveries in academic and industrial fields by making it possible to provide effective and efficient means for micro-fabrication of fine objects in the range of micro and nano-meters.

Although embodiments of the invention are described above, it is clear to those skilled person in the art that various modifications and applications are possible without departing from the scope of the present inventions.

What is claimed is:

1. A fast atomic beam source for generating a uniform and straight atomic beam, said source comprising:

a discharge tube;

a gas inlet extending into said discharge tube for introducing therein a gas;

an inductively coupled plasma generator for generating gas plasma in a plasma formation region in said discharge tube by exciting said gas therein to a plasma state;

an upstream positive electrode positioned upstream of said plasma formation region and a downstream negative electrode positioned downstream of said plasma formation region, said upstream electrode having therein gas passages to enable passage therethrough of the gas into said plasma formation region;

a voltage generation device for applying a voltage between said electrodes and creating an electric field therebetween, thereby causing positive ions to be accelerated toward said downstream electrode;

said upstream electrode and said downstream electrode both being plate-shaped, whereby said electric field is parallel and said positive ions are accelerated uniformly toward said downstream electrode; and said downstream electrode having therein beam control openings operable to pass therethrough said positive ions while neutralizing said ions to thereby emit a uniform and straight parallel atomic beam.

2. A source as claimed in claim 1, wherein said plate-shaped electrodes extend transverse to a longitudinal dimension of said discharge tube and parallel to each other.

3. A source as claimed in claim 1, wherein each said beam control opening has a length of from one to five times a diameter thereof.

4. A source as claimed in claim 1, wherein each said beam control opening has a length of from five to twenty times a diameter thereof.

5. A source as claimed in claim 1, wherein each said beam control opening has a length greater than twenty times a diameter thereof.

6. A fast atomic beam source for generating a uniform and straight atomic beam, said source comprising:

a discharge tube;

a gas inlet extending into said discharge tube for introducing therein a gas;

an inductively coupled plasma generator for generating gas plasma in a plasma formation region in said discharge tube by exciting said gas therein to a plasma state;

an upstream positive electrode and a downstream negative electrode both positioned downstream of said plasma formation region and defining therebetween a space, said upstream electrode having therein passages through which plasma from said plasma formation region can pass to said space;

a voltage generation device for applying a voltage between said electrodes and creating an electric field in said space therebetween, thereby causing positive ions to be accelerated toward said downstream electrode;

said upstream electrode and said downstream electrode both being plate-shaped, whereby said electric field is parallel and said positive ions are accelerated uniformly toward said downstream electrode; and said downstream electrode having therein beam control openings operable to pass therethrough said positive ions while neutralizing said ions to thereby emit a uniform and straight parallel atomic beam.

7. A source as claimed in claim 6, wherein said plate-shaped electrodes extend transverse to a longitudinal dimension of said discharge tube and parallel to each other.

8. A source as claimed in claim 6, wherein each said beam control opening has a length of from one to five times a diameter thereof.

9. A source as claimed in claim 6, wherein each said beam control opening has a length of from five to twenty times a diameter thereof.

10. A source as claimed in claim 6, wherein each said beam control opening has a length greater than twenty times a diameter thereof.

11. A source as claimed in claim 6, wherein each said passage in said upstream electrode has a diameter that is no greater than a length of a plasma sheath, and each said passage has a length equal to 0.2 to 1.0 times said diameter.

12. A source as claimed in claim 6, wherein each said passage in said upstream electrode has a diameter of 1 to 3 times a length of a plasma sheath, and each said passage has a length equal to 0.2 to 1.0 times said diameter.

13. A source as claimed in claim 6, wherein said downstream electrode has a thickness greater than said upstream electrode.

14. A source as claimed in claim 6, wherein said beam control openings are aligned with and of the same diameter as respective said passages.

15. A source as claimed in claim 6, further comprising means for adjusting a separation distance between said upstream and downstream electrodes, thereby regulating density of said atomic beam.

16. A source as claimed in claim 6, further comprising means for exhausting gas from said space and thereby increasing a differential pressure between said plasma formation section and said space.

17. A source as claimed in claim 16, wherein said means comprises an exhausting means connected to said space.

18. A source as claimed in claim 16, wherein said means comprises a hole through a wall defining said space.

19. A source as claimed in claim 6, further comprising an insulation member filling said space and having holes aligned with respective said passages and openings.

20. A source as claimed in claim 19, wherein said upstream and downstream electrodes and said insulation member comprise an integral unit.

* * * * *